US007201805B2

(12) United States Patent
Thouvenot et al.

(10) Patent No.: US 7,201,805 B2
(45) Date of Patent: Apr. 10, 2007

(54) GREASE REMOVING METHOD AND DEVICE

(75) Inventors: Pascal Thouvenot, Jouques (FR); Pierre Plume, Manosque (FR)

(73) Assignee: Commissariat a l'Energie Atomique, Paris (FR)

( * ) Notice: Subject to any disclaimer, the term of this patent is extended or adjusted under 35 U.S.C. 154(b) by 344 days.

(21) Appl. No.: 10/380,630

(22) PCT Filed: Sep. 28, 2001

(86) PCT No.: PCT/FR01/03015

§ 371 (c)(1),
(2), (4) Date: Mar. 21, 2003

(87) PCT Pub. No.: WO02/26923

PCT Pub. Date: Apr. 4, 2002

(65) Prior Publication Data

US 2004/0079394 A1 Apr. 29, 2004

(30) Foreign Application Priority Data

Sep. 29, 2000 (FR) ..... 00 12428

(51) Int. Cl.
*B08B 3/00* (2006.01)

(52) U.S. Cl. ..... 134/26; 134/40

(58) Field of Classification Search ..... 134/26, 134/40, 105, 95.1, 108, 109, 110
See application file for complete search history.

(56) References Cited

U.S. PATENT DOCUMENTS 5,786,319 A * 7/1998 Pedersen et al. ..... 510/423

FOREIGN PATENT DOCUMENTS

| | | |
|---|---|---|
| EP | 0 688 860 | 12/1995 |
| FR | 2 751 899 | 2/1998 |
| JP | 06-122897 | * 5/1994 |
| JP | 10 036894 | 2/1998 |
| WO | 94 28196 | 12/1994 |

* cited by examiner

*Primary Examiner*—Zeinab El-Arini
(74) *Attorney, Agent, or Firm*—Oblon, Spivak, McClelland, Maier & Neustadt, P.C.

(57) ABSTRACT

This invention relates to a degreasing process and device. It is particularly useful for degreasing surfaces coated with lanoline. The process according to this invention comprises a step to clean the surface to be degreased with a cleaning solvent and a step to rinse the cleaned surface with a rinsing solvent, said cleaning solvent including a solvent A comprising dipropylene glycol monomethyl ether with a boiling point of more than 100° and without a flash point or with a flash point of more than 70°, and said rinsing solvent comprising a solvent B comprising 1,1,1,2,3,4,4,5,5,5-decafluoropentane with a boiling point less than 70° and a surface tension less than 30 mN/m.

4 Claims, 3 Drawing Sheets

GREASE REMOVING METHOD AND DEVICE

TECHNICAL FIELD OF THE INVENTION

This invention relates to a degreasing method and device.

It is used to degrease surfaces coated with lanoline or other greases.

PRIOR ART

Chlorofluorocarbons have been widely used as degreasing products. Among these products, CFC113 has been used due to its strong degreasing capacity, particularly for animal greases such as lanoline.

However, their production and marketing have been prohibited since 1995 since they destroy the ozone layer.

Many physical and chemical products and methods have been developed since then in an attempt to replace fluorocarbons and particularly CFC113.

Some physical processes make use of abrasion and laser techniques.

Some chemical processes make use of temporary solutions in an attempt to replace CFC113, for example using a unique hydrofluorocarbon type organic solvent, and particularly HCFC-141b (trademark). In these solvents, chlorine atoms are replaced by hydrogen atoms in order to reduce their life. However, they are still harmful to the ozone layer, and it is planned to prohibit them for 2004.

Other chemical processes make use of aqueous or semi-aqueous processes, hot or cold single solvent processes, and co-solvent processes.

Aqueous or semi-aqueous processes associate a cleaning phase done using surfactant solutions for aqueous processes, or an organic solvent for semi-aqueous processes, and a water rinsing phase. The technique is significantly different from the technique used for processes using fluorocarbons.

The single solvent cold process uses organic solvents derived from oil that have low flash points. However, the use of this type of product necessitates more safety constraints than other processes.

Apart from the above mentioned disadvantages, at the moment there are no solvents with characteristics similar to the characteristics of CFC113, in other words a low boiling point, a low surface tension, a high degreasing capacity with regard to greases such as lanoline, no flash point, and without any danger for the ozone layer.

Finally, there is no degreasing procedure with a degreasing efficiency similar to what can be obtained with processes using CFC113.

SUMMARY OF THE INVENTION

This invention specifically provides a degreasing process and device overcoming the above mentioned disadvantages, without any danger for the ozone layer, and capable of achieving the degreasing efficiency obtained with processes using CFC113.

DETAILED DESCRIPTION OF THE INVENTION

In particular, the process according to this invention is characterized in that it comprises a step to clean the surface to be degreased with a cleaning solvent and a step to rinse the cleaned surface with a rinsing solvent, said cleaning solvent including a solvent A with a boiling point of more than 100° C. and without a flash point or with a flash point of more than 70° C., and said rinsing solvent comprising a solvent B with a boiling point less than 70° C. and a surface tension less than 30 mN/m.

The process according to the invention is a co-solvent process.

It may be done cold or hot, preferably hot, for example from ambient temperature (20 to 25° C.) up to about 10° C. below the boiling point of the cleaning solvent.

According to the invention, the surface may advantageously be cleaned with the cleaning solvent in the presence of ultrasounds.

According to the invention, the solvent A may be chosen from among an alcohol, a cetone, an ester, a diester, an ether, a glycol ether or a mix of these products, and the solvent B may be chosen from among the hydrofluoroether, hydrofluorocarbon, or perfluorated alcanes families, or a mix of solvents chosen from among these families.

According to a first variant embodiment of this invention, the cleaning solvent may consist of pure solvent A, and the rinsing solvent may consist of pure solvent B. In other words, solvents A and B may be used separately and pure.

According to a second embodiment of this invention, the cleaning solvent comprising solvent A may also comprise the rinsing solvent comprising solvent B. In other words, the cleaning solvent may comprise solvent A and solvent B. Thus, solvent A may be used mixed with solvent B, and solvent B may be used pure.

According to the invention, solvent A may for example be dipropylene glycol monomethyl ether (DPM), and solvent B may for example be 1,1,1,2,3,4,4,5,5,5-decafluoropentane.

DPM is an organic solvent with an untreated chemical formula $C_7H_{16}O_3$ with a high boiling point of 188° C., and has an excellent degreasing capacity even with lanoline, since these two products are miscible in all proportions.

1,1,1,2,3,4,4,5,5,5-decafluoropentane with an untreated chemical formula $C_5H_2F_{10}$ has a boiling point of 55° C. and a low surface tension equal to 14.1 mN/m. Its ozone destruction capacity is zero. This product is marketed particularly by the Du Pont de Nemours Company under the VERTREL XF trademark.

If the cleaning solvent is a mix of solvent A and solvent B, the proportions may for example be 30 to 95% by volume of A in the mix, preferably from 60 to 80% by volume, the remaining being solvent B.

This invention is also applicable to the use of solvents A and B defined above, for example under the conditions described above, and the use of a device for implementation of the process according to the invention. The device is described in the examples given below.

Therefore, this invention consists particularly of associating two particular organic solvents, one for cleaning and one for rinsing which, for example used in a co-solvent process, cause a degreasing with a quality equivalent to or better than that the quality obtained with CFC113 according to prior art, without damaging the ozone layer. It is applicable to degreasing of all types of mineral, vegetable, animal or synthetic greases or oils, for example lanoline.

Other characteristics and advantages will become apparent to the man skilled in the art after reading the following example, given for illustrative purposes and in no way restrictive, with reference to the attached drawings.

BRIEF DESCRIPTION OF THE DRAWINGS

Figures

EXAMPLES

Figure 1:
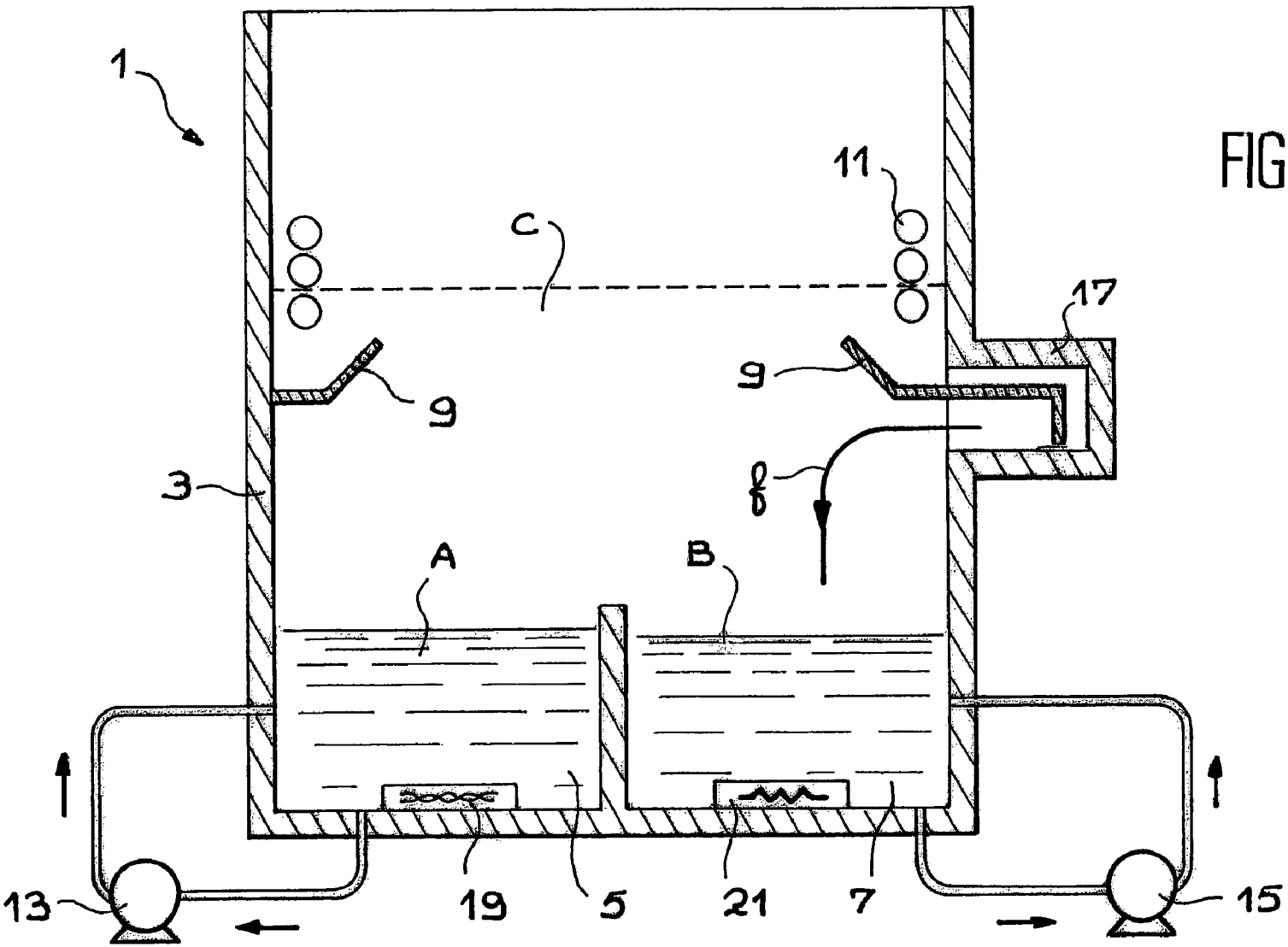
FIG. 1 is a diagrammatic representation of a co-solvent process according to a first alternative embodiment of this invention in which the cleaning and rinsing solvents are separated.
Figure 3:
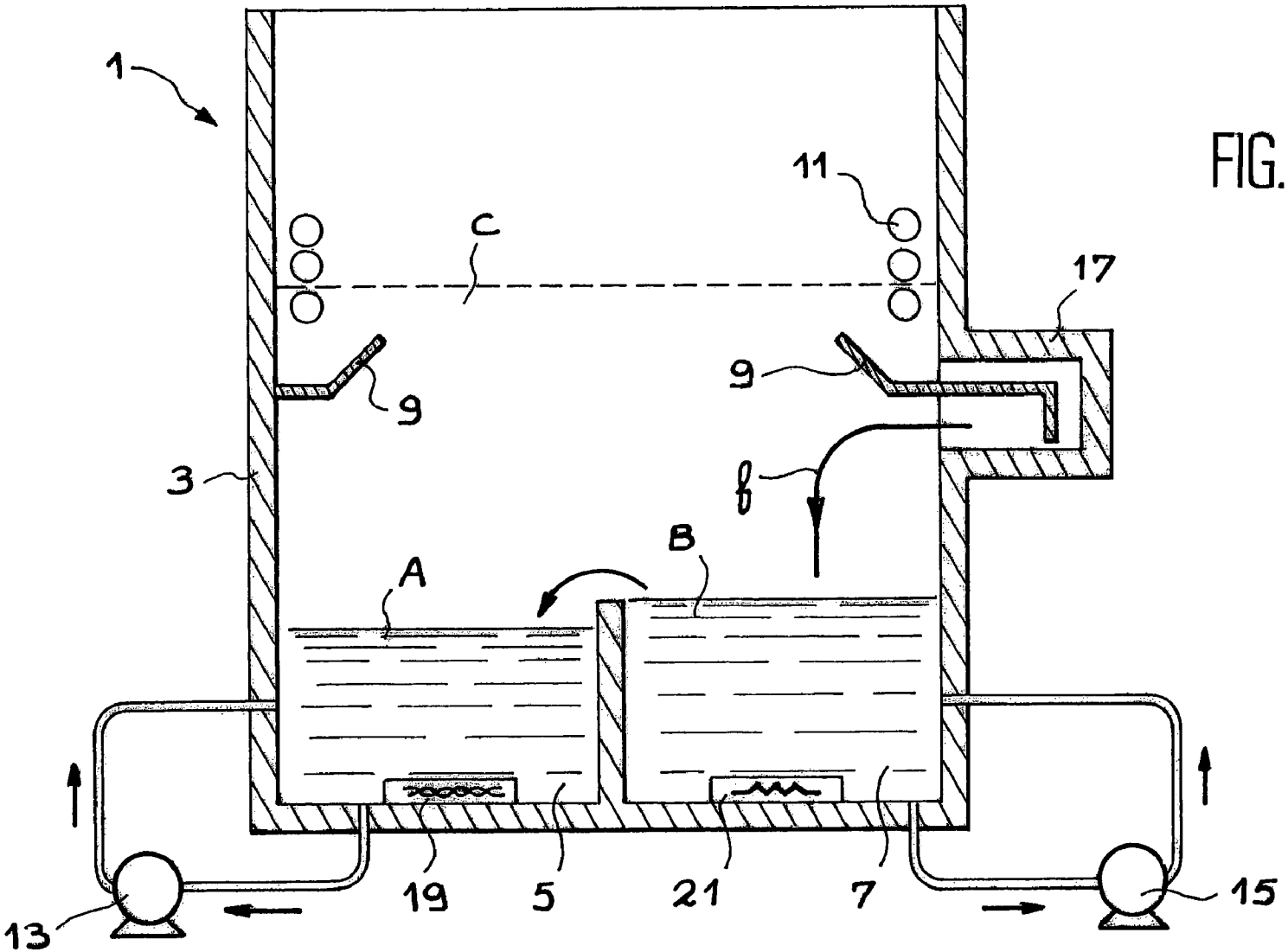
FIG. 3 is a diagrammatic view of a co-solvent process according to a second alternative embodiment of this invention in which the cleaning solvent is a mix of solvents according to the invention.

FIGS. 1 and 3 are diagrammatic views of a device used for implementation of the process according to two different embodiments of this invention.

In these figures, the device 1 comprises a containment 3 containing a cleaning tank 5 that will contain a cleaning solvent, a rinsing tank 7 that will contain a rinsing solvent, a condensation gutter 9 placed around the periphery of the containment 3 above tanks 5 and 7, condensation coils 11 placed in the containment above tanks 5 and 7, and filtration means 13 and 15 for pumping and filtering the cleaning solvent and the rinsing solvent and reinjecting them into the tanks.

Preferably, the device comprises one or several of the following elements: a water separator 17, an ultrasound generator 19 for the cleaning tank 5, and a heating means 21 for the cleaning tank 5 (not shown) and the rinsing tank 7. The heating means may be a heating plate.

The condensation coils 9 are preferably connected to a cooling unit (not shown). They are in the top part of the device. They are used to condense rinsing solvent vapours.

The solvent thus condensed runs off into the condensation gutter 9 towards the water separator 17. This separator may be a chemical or physical separator. It removes the condensed water vapour from the condensed solvent. The solvent is then routed to the rinsing tank as shown by arrow f.

In both of the embodiments below, the cleaning solvent A is dipropylene glycol monomethyl ether (DPM), and the rinsing solvent B is 1,1,1,2,3,4,4,5,5,5-decafluoropentane marketed by the Du Pont de Nemours Company under the VERTREL XF trademark.

The surface to be cleaned is the surface of a part that is preferably metallic, but it could also be composed of any material compatible with the solvents A and B used, in other words not eroded by these solvents. For example, the part may be made of plastic, ceramic, or a semi-conducting type of material, etc. It is suspended in a basket (not shown) so that it can be immersed in a cleaning solvent subjected to ultrasounds and heated to a temperature of 50° C. It is degreased by solubilization of grease in the solvent. The part is then immersed in the rinsing solvent heated to a temperature slightly below its boiling point, in other words 53° C. It is then transferred into the intermediate part of the device where it is rinsed by the rinsing solvent in the gaseous phase above tanks 5 and 7. It is then brought to a cold air mattress (not shown) where it is thoroughly dried.

A rotation movement of the basket containing the part to be degreased in the different baths improved degreasing.

The degreasing efficiency of a part covered with lanoline using the process according to this invention was better than the efficiency obtained with process according to prior art, and particularly better than a process with CFC113.

This was demonstrated by a comparative study of the solubilization of the lanoline in CFC113 solvent and in solvent A according to this invention, and by a study of the degreasing kinetics.

The comparative study showed total solubility of lanoline in solvent A and solubility of only 440 g/l in CFC113.

Figure 2:
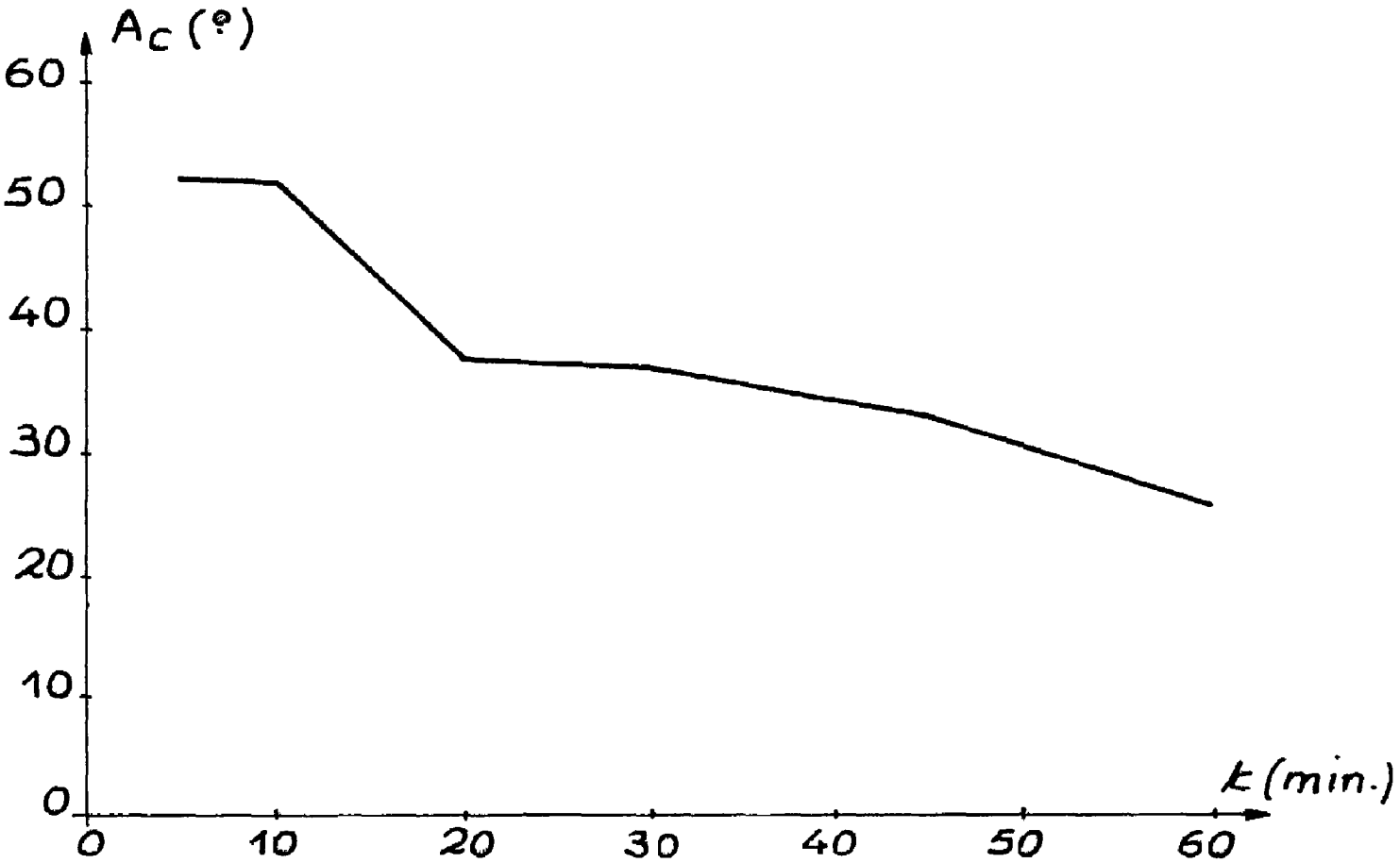
FIG. 2 is a graph illustrating the degreasing rate at 50° C. using the process according to this invention.

FIG. 2 shows a graph illustrating one of the degreasing rates at 50° C. using the process according to this invention with the solvents described above. On this graph, the abscissas axis represents the time in minutes, and the ordinates axis represents the contact angle in degrees (Ac in degrees).

The low angle of contact of 25° obtained after 1 hour of treatment confirms a very good quality of degreasing.

According to a first alternative embodiment of this invention shown in FIG. 1, the cleaning and rinsing solvents are kept in separate tanks.

According to a second alternative embodiment of this invention shown in FIG. 3, the process is used with a mix of the above mentioned two solvents in the cleaning tank. The rinsing solvent contained in the mix of the cleaning tank evaporates under the action of heating and ultrasounds. The concentration of solvent B in the mix of solvents A+B is adjusted by continuous pouring from the rinsing tank into the cleaning tank containing the two solvents, to keep the content of solvent A in the mix preferably at between 60 and 80%.

This second alternative embodiment is a means of obtaining a better degreasing quality than is possible with the first variant due to the additional stirring of the solvent mix A and B by cavitation, using ultrasounds, and bubbling of solvent B.

The invention claimed is:

1. A process for degreasing a surface, comprising:

cleaning the surface with a cleaning solvent consisting of dipropylene glycol monomethyl ether having a boiling point of more than 100° C. and having no flash point or a flash point of more than 70° C.; and rinsing the cleaned surface with a rinsing solvent consisting of 1,1,1,2,3,4,4,5,5,5-decafluoropentane having a boiling point of less than 70° C. and a surface tension of less than 30 mN/m.

2. The process according to claim 1, wherein: degreasing the surface consists of eliminating at least one of lanoline, mineral oil, vegetable oil, animal oil, synthetic oil, mineral grease, vegetable grease, animal grease, and synthetic grease, from the surface.

3. A process for degreasing a surface, comprising:

cleaning the surface with a cleaning solvent consisting of dipropylene glycol monomethyl ether having a boiling point of more than 100° C. and having no flash point or a flash point of more than 70° C., mixed with 1,1,1,2,3,4,4,5,5,5-decafluoropentane having a boiling point of less than 70° C. and a surface tension of less than 30 mN/m; and rinsing the cleaned surface with a rinsing solvent consisting of 1,1,1,2,3,4,4,5,5,5-decafluoropentane having a boiling point of less than 70° C. and a surface tension of less than 30 mN/m.

4. The process according to claim 3, wherein degreasing the surface consists of eliminating at least one of lanoline, mineral oil, vegetable oil, animal oil, synthetic oil, mineral grease, vegetable grease, animal grease, and synthetic grease, from the surface.

* * * * *